US005171626A

United States Patent [19]

Nagamine et al.

[11] Patent Number: 5,171,626

[45] Date of Patent: Dec. 15, 1992

[54] INK-JET RECORDING MEDIUM AND INK-JET RECORDING METHOD MAKING USE OF IT

[75] Inventors: Satoshi Nagamine; Hiroshi Sato; Yutaka Kurabayashi, all of Yokohama, Japan

[73] Assignee: Canon Kabushiki Kaisha, Tokyo, Japan

[21] Appl. No.: 673,455

[22] Filed: Mar. 22, 1991

[30] Foreign Application Priority Data

Apr. 2, 1990 [JP] Japan ..... 2-84930

[51] Int. Cl.[5] ..... B41M 5/00

[52] U.S. Cl. ..... 428/212; 428/195; 428/304.4; 428/329; 428/341; 346/135.1; 346/1.1

[58] Field of Search ..... 428/195, 323, 211, 452, 428/514, 212, 913, 914, 304.4, 329, 341; 346/1.1, 135.1

[56] References Cited

U.S. PATENT DOCUMENTS 5,041,328 8/1991 Akiya et al. ..... 428/195
5,081,470 1/1992 Kurabayashi et al. ..... 346/1.1

FOREIGN PATENT DOCUMENTS 0331125 9/1989 European Pat. Off. .
60-49990 3/1985 Japan .
61-57380 3/1986 Japan .
6475280 3/1989 Japan .
1-108083 4/1989 Japan .

*Primary Examiner*—B. Hamilton Hess
*Assistant Examiner*—W. Krynski
*Attorney, Agent, or Firm*—Fitzpatrick, Cella, Harper & Scinto

[57] ABSTRACT

An ink-jet recording medium comprises a substrate and a pigment layer. The pigment layer comprises an upper layer and lower layer. The upper layer contains as a major pigment an aluminum oxide having a specific surface area ranging from 90 $m^2/g$ to 170 $m^2/g$. The lower layer contains as a major pigment an aluminum oxide having a specific surface area smaller than the aluminum oxide in the upper layer, an inorganic pigment selected from a carbonate or silicate of calcium, a carbonate or silicate of magnesium, a silicate of aluminum and hydrotalcite having a specific surface are of not more than 150 $m^2/g$, or a basic magnesium carbonate having a specific surface area of not more than 150 $m^2/g$.

29 Claims, No Drawings

INK-JET RECORDING MEDIUM AND INK-JET RECORDING METHOD MAKING USE OF IT

BACKGROUND OF THE INVENTION

1. Field of the Invention

The present invention relates to an ink-jet recording medium that can be suitably used in an ink-jet recording process. More particularly it relates to a recording medium having superior absorption properties and color-forming performance for a water-based ink, and also capable of achieving a superior sharpness of recorded images obtained.

The present invention also relates to an ink-jet recording medium capable of providing recorded images that may cause less indoor color changes and have a good storage stability.

The present invention still also relates to an ink-jet recording method making use of such a medium.

2. Related Background Art

Hitherto known recording mediums used for ink-jet recording include;

(1) those comprising an ordinary paper mainly composed of pulp, so made as to have a low degree of sizing as in filter paper or blotting paper; and (2) those comprising a substrate paper and a coating layer provided thereon using a pigment such as silica or zeolite, which is porous, has a large oil absorption and is capable of adsorbing a coloring component contained in ink, as disclosed in Japanese Patent Application Laid-open No. 56-148585.

Meanwhile, in an ink-jet recording system that forms a color image with a high quality level and a high resolution, there is a demand for a particularly good image storage stability. Because of such a demand, methods of improving resistance to the fading of images due to sunlight, visible light, ultraviolet light, etc. are known in the art (see, for example, Japanese Patent Applications Laid-open No. 60-49990 and No. 61-57380).

Recently, however, the problem of image storage stability concerning indoor color changes of recorded images has been highlighted as a problem peculiar to coated papers.

The fading of images that has been hitherto questioned is a phenomenon caused when dyes present in recorded images are decomposed because of irradiation with visible light or ultraviolet light. This does not occur at the place not exposed to direct sunlight. At the place exposed to direct sunlight, this is a problem of fading that may arise also in respect of images recorded on what is called PPC paper, commonly available, and recording mediums of the types of any of the above (1) and (2).

The indoor color changes referred to in the present invention do not occur on non-coated paper such as PPC paper, and hence the problem of indoor color changes is peculiar to coated paper. Thus, this can be considered to be a problem greatly caused by a pigment that forms a coat layer.

In general, the indoor color changes can be inhibited in a recording medium having a coat layer comprised of a pigment having a small specific surface area as exemplified by calcium carbonate or kaolin. When such a pigment is used, however, the pigment can not trap a dye because of its small specific surface area, so that resulting images may have a low density and can not be images with a high image quality. On the other hand, in the case of recording mediums having a coat layer comprised of highly active silica with a large specific surface area, it has been possible to obtain images with a high density but impossible to inhibit indoor color changes.

Japanese Patent Laid-open Application No. 64-75280 discloses a recording medium containing an aluminum oxide. In such a recording medium, the resistance to indoor color changes can be improved to a certain extent, but still has been unsatisfactory.

Moreover, in an instance in which pigments of different kinds are mixed to form a coat layer, either image density or resistance to indoor color changes has been unsatisfactory.

Japanese Patent Application Laid-open No. 1-108083 discloses a recording medium comprising dual ink-receiving layers, wherein aluminum oxide is used together in its surface layer so that image density can be improved. There, however, a limitation on the amount of the aluminum oxide taking account of the inhibition of indoor color changes, so that the density of resulting images has been unsatisfactory.

Namely, in conventional techniques, an attempt to make image density and image quality level higher brings about indoor color changes, and on the other hand an attempt to inhibit indoor color changes results in a lowering of image density. These conflict with each other, and have been considered incompatible.

SUMMARY OF THE INVENTION

Accordingly, an object of the present invention is to provide a recording medium capable of simultaneously settling the conflicting subjects of giving images with high density and high quality level and giving images with very slight indoor color changes, which could not have been settled by the prior art; and to provide an ink-jet recording method making use of such a recording medium.

The above objects can be achieved by the present invention described below.

The present invention provides an ink-jet recording medium comprising a substrate and a pigment layer provided on the substrate, wherein said pigment layer comprises i) an upper layer containing as a major pigment an aluminum oxide and ii) a lower layer containing as a major pigment an aluminum oxide having a smaller specific surface area than the aluminum oxide in the upper layer.

In another embodiment, the present invention provides an ink-jet recording medium comprising a substrate and a pigment layer provided on the substrate, wherein said pigment layer comprises i) an upper layer containing as a major pigment an aluminum oxide having a specific surface area ranging from 90 $m^2/g$ to 170 $m^2/g$ and ii) a lower layer containing as a major pigment an inorganic pigment having a specific surface area of not more than 150 $m^2/g$, selected from the following Group A.

Group A: a carbonate or silicate of calcium, a carbonate or silicate of magnesium, a silicate of aluminum and hydrotalcite.

In still another embodiment, the present invention provides an ink-jet recording medium comprising a substrate and a pigment layer provided on the substrate, wherein said pigment layer comprises i) an upper layer containing as a major pigment an aluminum oxide having a specific surface area ranging from 90 $m^2/g$ to 170 $m^2/g$ and ii) a lower layer containing as a major pigment a basic magnesium carbonate having a specific surface area of not more than 150 $m^2/g$.

The present invention also provides an ink-jet recording method comprising forming an image by imparting ink droplets to any one of the above recording mediums.

DESCRIPTION OF THE PREFERRED EMBODIMENTS

In the present invention, it has been discovered that a high image density can be obtained and also indoor color changes can be well inhibited when a pigment with a smaller specific surface area is used in the lower layer and an aluminum oxide (an oxide of aluminum) with a larger specific surface area is used in the upper layer.

More specifically, the lower layer contains as a major pigment a pigment having a relatively small specific surface area and the upper layer contains as a major pigment a pigment having a relatively large specific surface area, where the former complements the latter in respect of the inhibition of indoor color changes and the latter complements the former in respect of the improvement of image density.

The present invention will be described below in greater detail by giving preferred embodiments.

The ink-jet recording medium of the present invention is comprised of a substrate and two or more pigment layers formed thereon.

The substrate that can be used may include commonly used hard-sized paper, soft-sized paper having ink absorption properties, neutralized paper and polyethylene terephthalate film. In particular, it is preferred to use neutralized paper as the substrate. The following description concerns an instance in which the substrate is made of hard-sized paper commonly used.

A first characteristic feature of the present invention is that the recording medium is comprised of a substrate and two or more pigment layers provided thereon, and the layer farthest from the substrate (hereinafter "upper layer") contains an aluminum oxide as a major pigment.

The aluminum oxide referred to in the present invention can be produced by a method according to what is called the Bayer process, in which aluminum hydroxide obtained by treating bauxite with hot sodium hydroxide is calcined. Besides this method, it is also possible to use those produced by a method in which metal aluminum pellets are subjected to spark discharging in water and then the aluminum hydroxide thus obtained is calcined, a method in which aluminum chloride is vaporized at a high temperature and then oxidized in a gaseous phase, and a method in which an inorganic aluminum salt (such as alum) is decomposed.

The crystal structure of the aluminum oxide is known to undergo conversion depending on the temperatures at which the heat treatment is carried out, as from aluminum hydroxide of gibbsite type or Boehmite type to aluminum oxide of $\gamma$-form, $\sigma$-form, $\eta$-form, $\theta$-form or $\alpha$-form. Of course, it is possible in the present invention to use those produced by any of these methods and having any of these crystal structures.

The purity of the aluminum oxide varies depending on its production method and the degree of refining. Those which can be used in the present invention may not be limited to those usually called high-purity alumina, containing 99.99% of $Al_2O_3$, and those containing 80 to 90% of $Al_2O_3$ can also be enough.

The aluminum oxide used in the present invention should preferably have a specific surface area ranging from 90 $m^2/g$ to 170 $m^2/g$. An aluminum oxide with a specific surface area more than 170 $m^2/g$ may cause serious indoor color changes of recorded images. On the other hand, an aluminum oxide with a specific surface area less than 90 $m^2/g$ may cause a lowering of the density of images obtained.

According to what has been found by the present inventors, the indoor color changes of recorded images are due to oxidation decomposition of a dye. In the case when the dye is trapped on the surface of a recording medium, the dye may be readily oxidized so much. In particular, when a pigment with a large specific surface area is used, the oxidation may strongly proceed to bring about indoor color changes. For this reason, it is particularly preferred to use as the pigment used in the upper layer those having a specific surface area of from 90 $m^2/g$ to 170 $m^2/g$.

Particles of the aluminum oxide used in the present invention may preferably have an average particle diameter of not more than 70 $\mu m$ and not less than 0.005 $\mu m$, more preferably not more than 10 $\mu m$, and still more preferably not more than 5 $\mu m$ in view of smoothness of print surfaces and dot roundness of shot ink.

In the upper layer, other pigment may also be used in combination, in addition to the above aluminum oxide, provided that in order to obtain the effect of the present invention it is essential to use the aluminum oxide as a major pigment. Namely, the pigment or pigments additionally used in combination with the aluminum oxide must be not more than 50% by weight based on all pigments contained in the upper layer. In other words, the aluminum oxide in the upper layer must be contained in an amount of not less than 50% by weight based on all pigments contained in the upper layer, and should particularly preferably be in an amount of not less than 60% by weight in view of inhibition of indoor color changes, high density and high chroma.

A second characteristic feature of the present invention is that the lower layer contains as a major pigment an aluminum oxide having a smaller specific surface area than the aluminum oxide contained in the upper layer as a major pigment.

The aluminum oxides previously described may be used here, provided that the aluminum oxide contained in the lower layer has a specific surface area of less than 90 $m^2/g$, and preferably not more than 60 $m^2/g$ and not less than 10 $m^2/g$. If the specific surface area of the aluminum oxide contained in the lower layer is more than 90 $m^2/g$, the lower layer tends to affect the whole pigment layer to weaken the effect of inhibition of indoor color changes.

In the lower layer also, other pigment may be used in combination, in addition to the above aluminum oxide, provided that in order to obtain the effect of the present invention it is essential to use the aluminum oxide as a major pigment. Namely, the pigment or pigments additionally used in combination with the aluminum oxide must be not more than 50% by weight based on all pigments contained in the lower layer. In other words, the aluminum oxide in the lower layer must be contained in an amount of not less than 50% by weight based on all pigments contained in the lower layer, and should preferably be in an amount of not less than 60% by weight in view of inhibition of indoor color changes. More preferably, it should be contained in an amount of not less than 80% by weight. Particles of the pigment(s)

in the lower layer should preferably have an average particle diameter of not more than 20 μm and not less than 0.005 μm, and more preferably not more than 10 μm in order to improve smoothness of coat surfaces and roundness of printed dots.

Another characteristic feature of the present invention is that the lower layer contains as a major pigment at least one selected from inorganic pigments such as calcium carbonate, calcium silicate, magnesium silicate, magnesium carbonate, aluminum silicate and hydrotalcite (hereinafter "inorganic pigment of Group A"), where the inorganic pigment of Group A having a specific surface area of not more than 150 $m^2/g$ is used and also the aluminum oxide contained in the upper layer as a major pigment has a specific surface area of from 90 $m^2/g$ to 170 $m^2/g$.

Although the reason is unclear, it can be presumed that, since the aluminum oxide has a stronger activity than the inorganic pigment of Group A, its specific surface area must be controlled to be smaller than that of the inorganic pigment of Group A when it is contained in the lower layer.

Among the above pigments of the inorganic pigment of Group A, a calcium carbonate, a calcium silicate, a magnesium silicate and a magnesium carbonate are preferred, and a basic magnesium carbonate is particularly preferred. These inorganic pigments may be used alone or in combination.

When the inorganic pigment of Group A is used, those having a specific surface area of not more than 150 $m^2/g$ must be used, preferably those having a specific surface area of 100 $m^2/g$, more preferably those having a specific surface area of not less than 10 $m^2/g$. Use of those having a specific surface area more than 150 $m^2/g$ is unsuited for the same reason stated in respect of the aluminum oxide.

In the lower layer, other pigment may also be used in combination, in addition to the inorganic pigment of Group A, provided that in order to obtain the effect of the present invention it is essential to use the above inorganic pigment of Group A as a major pigment. Namely, the pigment or pigments additionally used in combination with the inorganic pigment of Group A must be not more than 50% by weight based on all pigments contained in the lower layer. In other word, the inorganic pigment of Group A must be contained in an amount of not less than 50% by weight based on all pigments contained in the lower layer, and should preferably be in an amount of not less than 60% by weight in view of inhibition of indoor color changes. More preferably, it should be contained in an amount of not less than 80% by weight. Particles of the pigment(s) in the lower layer should preferably have an average particle diameter of not more than 20 μm and not less than 0.005 μm, and more preferably not more than 10 μm in order to improve smoothness of coat surfaces and roundness of printed dots.

The pigment layer of the recording medium obtained by the present invention is comprised of, in addition to the pigments described above, a binder and other additives.

As the binder used in the present invention, binders of the same kind may be used in the whole upper layer and lower layer, or those of different kind may be used.

Examples of the binder are conventionally known water-soluble polymers such as polyvinyl alcohol, starch, oxidized starch, cationized starch, casein, carboxymethyl cellulose, gelatin, hydroxyethyl cellulose and acrylic resins, and water-dispersed polymers such as SBR latex and a polyvinyl acetate emulsion, which may be used alone or in combination of two or more kinds.

In the present invention, the pigment(s) and the binder may preferably be used in a proportion of the pigment to the binder, ranging from 10/1 to ¼, and more preferably from 6/1 to ½. This applies to both the upper layer and the lower layer. Use of the binder in a proportion larger than ¼ results in a lowering of the ink absorption properties. On the other hand, use of the pigment in a proportion larger than 10/1 may make adhesion poor to cause the problem of dusting. Thus these are undesirable.

In the present invention, the pigment layer may optionally be further incorporated with additives such as a dye fixing agent (an anti-hydration agent), a fluorescent brightener, a surface active agent, an anti-foaming agent, a pH adjuster, a mildewproofing agent, an ultraviolet absorbent, an antioxidant and a dispersant. These may be added to both the upper layer and the lower layer, or may be added to any one of them. These additives may be arbitrarily selected according to the purpose.

In the recording medium of the present invention, obtained under the constitution as described above, the dried coating weight in the upper layer may preferably be in the range of from 1 $g/m^2$ to 10 $g/m^2$, and more preferably from 3 $g/m^2$ to 7 $g/m^2$. A dried coating weight less than 1 $g/m^2$ may give little effect for the upper layer provided. On the other hand, a dried coating weight of more than 10 $g/m^2$ results in cover-up of the lower layer with the upper layer to make the inhibition of indoor color changes less effective, which is attributable to the feature that the pigment with a smaller specific surface area is used in the lower layer. The dried coating weight in the lower layer may preferably be in the range of from 1 $g/m^2$ to 29 $g/m^2$, and more preferably from 5 $g/m^2$ to 20 $g/m^2$.

As for the total coating weight, it may be changed depending on the ink absorption power of the pigments, the ink absorption power of the substrate and the ink absorption properties as desired in the recording medium. In view of the problem of dusting and the problem of cost, the total coating weight should be controlled to be not more than 30 $g/m^2$.

In preparing the recording medium of the present invention, coating solutions for the lower layer and upper layer, containing the components as previously described, are applied to the surface of the substrate by a known method as exemplified by roll coating, blade coating, air-knife coating, gate roll coating, or size press coating. When a water-based coating solution comprised of the pigment(s) and a binder is applied to the substrate, the coating formed may thereafter be dried using a conventionally known drying method using, for example, a hot-air drying oven or a heated drum. Thus the recording medium of the present invention can be obtained.

In order to smooth the surface of the pigment layer or ink-receiving layer, or to increase the surface strength of the ink-receiving layer, the recording medium may further be super-calendered in its manufacturing steps.

Images may be formed on the recording medium of the present invention, obtained in the manner as described above, by ink-jet recording using water-based multicolor inks, e.g., yellow (Y), magenta (M), cyan (C) and black (B), so that the resulting images can have a sufficiently high density and also show superior storage stability without causing indoor color changes.

As the ink itself that is used in carrying out recording on the recording medium of the present invention as described above, any known inks can be used. For example, as recording agents therefor, it is possible to use water-soluble dyes as typified by direct dyes, acid dyes, basic dyes, reactive dyes and food dyes, which are suitable particularly for inks used in ink-jet recording. The following are examples of those preferred as dyes capable of providing images that can satisfy fixing performance, color-forming performance, sharpness, stability, light-resistance and other required performances when used in combination with the recording medium described above.

Direct dyes such as C.I. Direct Black 17, 19, 32, 51, 71, 108, 146;
C.I. Direct Blue 6, 22, 25, 71, 86, 90, 106, 199;
C.I. Direct Red 1, 4, 17, 28, 83;
C.I. Direct Yellow 12, 24, 26, 86, 98, 142;
C.I. Direct Orange 34, 39, 44, 46, 60;
C.I. Direct Violet 47, 48;
C.I. Direct Brown 109; and
C.I. Direct Green 59.
Acid dyes such as C.I. Acid Black 2, 7, 24, 26, 31, 52, 63, 112, 118;
C.I. Acid Blue 9, 22, 40, 59, 93, 102, 104, 113, 117, 120, 167, 229, 234;
C.I. Acid Red 1, 6, 32, 37, 51, 52, 80, 85, 87, 92, 94, 115, 180, 256, 317, 315;
C.I. Acid Yellow 11, 17, 23, 25, 29, 42, 61, 71;
C.I. Acid Orange 7, 19; and
C.I. Acid Violet 49.
Also usable are C.I. Basic Black 2;
C.I. Basic Blue 1, 3, 5, 7, 9, 24, 25, 26, 28, 29;
C.I. Basic Red 1, 2, 9, 12, 13, 14, 37;
C.I. Basic Violet 7, 14, 27; and
C.I. Basic Black 1, 2.

The above dye for ink is by no means limited to these dyes. The present invention can be remarkably effective particularly when C.I. Food Black 2, C.I. Acid Black 24, C.I. Acid Black 26, C.I. Direct Blue 86, C.I. Direct Blue 199 are used, which are dyes liable to undergo indoor color changes.

Such water soluble dyes are commonly used in an amount of from about 0.1 to 20% by weight in conventional inks, and may also be used in the same amount in the present invention.

A solvent used in the water-based ink used in the present invention includes water or a mixed solvent of water and a water-soluble organic solvent. Particularly preferred is a mixed solvent of water and a water-soluble organic solvent, containing as the water-soluble organic solvent a polyhydric alcohol having the effect of preventing the ink from evaporating. As the water, it is preferred not to use commonly available water containing various ions but to use deionized water.

The water-soluble organic solvent may be contained in the ink in an amount ranging usually from 0% by weight to 95% by weight, preferably from 2% by weight to 80% by weight, and more preferably from 5% by weight to 50% by weight, based on the total weight of the ink.

The water may preferably be contained in an amount of from 20% by weight to 98% by weight, and more preferably from 50% by weight to 95% by weight, based on the total weight of the ink.

In addition to the components described above, the above ink may optionally contain a surface active agent, a viscosity modifier, a surface tension modifier and so forth.

The method for carrying out recording by imparting the above ink to the recording medium previously described may preferably be ink-jet recording. The ink-jet recording may be of any method so long as it is a method that can effectively release an ink from nozzles and impart the ink to a recording medium serving as a target.

In particular, what can be effectively used is the method disclosed in Japanese Patent Application Laid-open No. 54-59936, which is an ink-jet recording method in which an ink having received the action of heat energy causes an abrupt change in volume and the ink is ejected from nozzles by the force of action produced by this change in state.

The present invention will be described below in greater detail by giving Examples and Comparative Examples. In the following, "part(s)" or "%" is by weight unless particularly noted.

EXAMPLE 1

To wood free paper with a degree of stöckigt sizing of 45 seconds, a basis weight of 80 g/m$^2$ and a thickness of 100 μm, the following coating solution (1-a) was applied by bar coating in an amount giving a dried coating weight of 13 g/m$^2$ followed by drying at 110° C. for 5 minutes to form a lower layer. On this lower layer, the following coating solution (1-b) was applied by bar coating in an amount giving a dried coating weight of 5 g/m$^2$ followed by drying at 110° C. for 3 minutes to form an upper layer, and further followed by super-calendering to give a recording medium according to the present invention.

| | |
|---|---|
| (Coating solution 1-a): | |
| Basic magnesium carbonate (available from Konoshima Kagaku K.K.; trade name: KINSEI; specific surface area: 30 m$^2$/g; average particle diameter: 6 μm) | 15 parts |
| Polyvinyl alcohol (available from Kuraray Co., Ltd; trade name: PVA-117; degree of saponification: 98.5%; degree of polymerization; 1,700) | 2.5 parts |
| Polyvinyl alcohol (available from Kuraray Co., Ltd; trade name: PVA-105; degree of saponification: 98.5%; degree of polymerization: 500) | 2.5 parts |
| Water | 80 parts |
| (Coating solution 1-b) | |
| γ-Alumina (available from Sumitomo Chemical Co., Ltd.; trade name: AKP-G; specific surface area; 140 m2/g; average particle diameter: 0.5 μm) | 12 parts |
| Polyvinyl alcohol (available from Kuraray Co., Ltd; trade name: PVA-117) | 2 parts |
| Polyvinyl alcohol (available from Kuraray Co , Ltd: trade name: PVA-105) | 2 parts |
| Polyallylamine hydrochloride (available from Nitto Boseki Co., Ltd.; trade name: PAA.HCl-10L; average molecular weight: 100,000) | 1 part |
| Water | 83 parts |

EXAMPLE 2

A recording medium according to the present invention was prepared in entirely the same manner as in Example 1 except that the coating solution for the upper layer was replaced with the following coating solution (2-b).

| (Coating solution 2-b) | |
|---|---|
| γ-Alumina (available from Sumitomo Chemical Co., Ltd.; trade name: AKP-G) | 8 parts |
| Basic magnesium carbonate (available from Konoshima Kagaku K.K.; trade name: KINSEI) | 4 parts |
| Polyvinyl alcohol (available from Kuraray Co., Ltd; trade name: PVA-117) | 2 parts |
| Polyvinyl alcohol (available from Kuraray Co., Ltd; trade name: PVA-105) | 2 parts |
| Polyallylamine hydrochloride (available from Nitto Boseki Co., Ltd.: trade name: PAA.HCl-10L) | 1 part |
| Water | 83 parts |

EXAMPLE 3

To wood free paper with a degree of stöckigt sizing of 45 seconds, a basis weight of 80 g/m$^2$ and a thickness of 100 μm, the following coating solution (3-a) was applied by bar coating in an amount giving a dried coating weight of 15 g/m$^2$ followed by drying at 110° C. for 5 minutes to form a lower layer. On this lower layer, the following coating solution (3-b) was applied by bar coating in an amount giving a dried coating weight of 7 g/m$^2$ followed by drying at 110° C. for 3 minutes to form an upper layer, and further followed by super-calendering to give a recording medium according to the present invention.

| (Coating solution 3-a): | |
|---|---|
| Alumina (available from Sumitomo Chemical Co., Ltd.; trade name: AKP-HP; specific surface area: 12 m$^2$/g; average particle diameter: 0.2 μm) | 12 parts |
| Polyvinyl alcohol (available from Kuraray Co., Ltd; trade name: PVA-117; degree of saponification: 98.5%; degree of polymerization: 1,700) | 2 parts |
| Polyvinyl alcohol (available from Kuraray Co.. Ltd; trade name: PVA-105; degree of saponification: 98.5%; degree of polymerization: 500) | 2 parts |
| Water | 84 parts |
| (Coating solution 3-b): | |
| γ-Alumina (available from Showa Denko K.K.; trade name: UA-5605; specific surface area: 60 m$^2$/g; average particle diameter: 0.05 μm) | 12 parts |
| Polyvinyl alcohol (available from Kuraray Co., Ltd: trade name: PVA-117) | 2 parts |
| Polyvinyl alcohol (available from Kuraray Co., Ltd; trade name: PVA-105) | 2 parts |
| Polyallylamine hydrochloride (available from Nitto Boseki Co., Ltd.: trade name: PAA.HCl-3L; average molecular weight: 10,000) | 1 part |
| Water | 83 parts |

EXAMPLE 4

A recording medium according to the present invention was prepared in entirely the same manner as in Example 3 except that the coating solution (3-b) was replaced with the following coating solution (4-b).

| (Coating solution 4-b) | |
|---|---|
| Alumina (available from Degussa Japan Co., Ltd.; trade name: Aluminium Oxide-C; specific surface area: 100 m$^2$/g; average particle diameter: 0.02 μm) | 10 parts |
| Polyvinyl alcohol (available from Kuraray Co., Ltd; trade name: PVA-117) | 2 parts |
| Polyvinyl alcohol (available from Kuraray Co., Ltd; trade name: PVA-105) | 1.5 parts |
| Polyallylamine hydrochloride (available from Nitto Boseki Co., Ltd.; trade name: PAA.HCl-3L: average molecular weight: 10,000) | 1 part |

-continued

| (Coating solution 4-b) | |
|---|---|
| Water | 85 parts |

EXAMPLES 5 TO 7

Lower layers were formed in entirely the same manner as in Example 3 except that the following coating solution (5-a) was used.

| (Coating solution 5-a) | |
|---|---|
| Alumina (available from Showa Denko K.K.; trade name: UA-5605) | 12 parts |
| Polyvinyl alcohol (available from Kuraray Co., Ltd; trade name: PVA-117) | 2 parts |
| Polyvinyl alcohol (available from Kuraray Co., Ltd; trade name: PVA-105) | 2 parts |
| Water | 84 parts |

The subsequent procedure of Example 3 was repeated except for respectively using coating solutions (5-b), (6-b) and (7-b) for forming the upper layers composed in the following manner. Three kinds of recording mediums of the present invention were thus prepared.

EXAMPLE 5

| (Coating solution 5-b) | |
|---|---|
| Alumina (available from Degussa Japan Co., Ltd.; trade name: Aluminium Oxide-C) | 10 parts |
| Polyvinyl alcohol (available from Kuraray Co., Ltd; trade name: PVA-117) | 2 parts |
| Polyvinyl alcohol (available from Kuraray Co., Ltd; trade name: PVA-105) | 1.5 parts |
| Polyallylamine hydrochloride (available from Nitto Boseki Co., Ltd.; trade name: PAA.HCl-3L | 1 part |
| Water | 85 parts |

EXAMPLE 6

| (Coating solution 6-b) | |
|---|---|
| Alumina (available from Degussa Japan Co., Ltd.; trade name: Aluminium Oxide-C) | 7.5 parts |
| Basic magnesium carbonate (available from Ube Chemical Industries Co., Ltd..; trade name: S-Type; specific surface area: 15 m$^2$/g; average particle diameter: 13 μm) | 2.5 parts |
| Polyvinyl alcohol (available from Kuraray Co., Ltd; trade name: PVA-117) | 2 parts |
| Polyvinyl alcohol (available from Kuraray Co., Ltd; trade name: PVA-105 | 1.5 parts |
| Polyallylamine hydrochloride (available from Nitto Boseki Co., Ltd.; trade name: PAA.HCl-3L) | 1 part |
| Water | 85 parts |

EXAMPLE 7

| (Coating solution 7-b) | |
|---|---|
| Alumina (available from Degussa Japan Co., Ltd.; trade name: Aluminium Oxide-C) | 5.5 parts |
| Basic magnesium carbonate (available from Ube Chemical Industries Co., Ltd..; trade name: S-Type; specific surface area: 15 m$^2$/g; average article diameter: 13 μm) | 4.5 parts |
| Polyvinyl alcohol (available from Kuraray Co., Ltd; trade name: PVA-117) | 2 parts |
| Polyvinyl alcohol (available from Kuraray Co., Ltd; | 1.5 parts |

-continued

| (Coating solution 7-b) | |
|---|---|
| trade name: PVA-105) | |
| Polyallylamine hydrochloride (available from Nitto Boseki Co., Ltd.; trade name: PAA.HCl-3L) | 1 part |
| Water | 85 parts |

EXAMPLE 8

A recording medium according to the present invention was prepared in entirely the same manner as in Example 1 except that the same coating solution (1-a) as in Example 1 was used as the coating solution for forming the lower layer and a coating solution (8-b) composed in the following manner was used as the coating solution for forming the upper layer.

| (Coating solution 8-b) | |
|---|---|
| Alumina (available from Degussa Japan Co., Ltd.; trade name: Aluminium Oxide-C) | 10 parts |
| Polyvinyl alcohol (available from Kuraray Co., Ltd; trade name: PVA-117) | 2 parts |
| Polyvinyl alcohol (available from Kuraray Co., Ltd; trade name: PVA-105) | 1.5 parts |
| Polyallylamine hydrochloride (available from Nitto Boseki Co., Ltd.; trade name: PAA.HCl-3L) | 1 part |
| Water | 85 parts |

EXAMPLE 9

A recording medium according to the present invention was prepared in entirely the same manner as in Example 1 except that the same coating solution (1-b) as in Example 1 was used as the coating solution for forming the upper layer and a coating solution (9-a) composed in the following manner was used as the coating solution for forming the lower layer.

| (Coating solution 9-a) | |
|---|---|
| Basic magnesium carbonate (available from Ube Chemical Industries Co., Ltd..; trade name: S-Type) | 15 parts |
| Polyvinyl alcohol (available from Kuraray Co., Ltd; trade name: PVA-117) | 2.5 parts |
| Polyvinyl alcohol (available from Kuraray Co., Ltd; trade name: PVA-105) | 2.5 parts |
| Water | 85 parts |

EXAMPLE 10

A recording medium according to the present invention was prepared in entirely the same manner as in Example 9 except that the coating solution (9-a) used therein was replaced with a coating solution (10-a) composed in the following manner.

| (Coating solution 10-a) | |
|---|---|
| Calcium silicate (available from Tokuyama Soda Co., Ltd..; trade name: Florite R; specific surface area: 110 $m^2/g$; average particle diameter: 20 $\mu m$) | 12 parts |
| Polyvinyl alcohol (available from Kuraray Co., Ltd; trade name: PVA-117) | 2 parts |
| Polyvinyl alcohol (available from Kuraray Co., Ltd; trade name: PVA-105 | 2 parts |
| Water | 84 parts |

COMPARATIVE EXAMPLE 1

To the same substrate as used in Example 1, the following coating solution (11-a) was applied by bar coating in an amount giving a dried coating weight of 20 $g/m^2$ followed by drying at 110° C. for 5 minutes, and further followed by super-calendering to give a recording medium of a comparative example.

| (Coating solution 11-a) | |
|---|---|
| Synthetic silica (available from Mizusawa Industrial Chemicals, Ltd.; trade name: Mizukasil P-527;) | 12 parts |
| Polyvinyl alcohol (available from Kuraray Co., Ltd; trade name: PVA-117) | 2 parts |
| Polyvinyl alcohol (available from Kuraray Co., Ltd; trade name: PVA-105) | 2 parts |
| Polyallylamine hydrochloride (avilable from Nitto Boseki Co., Ltd.; trade name: PAA.HCl-10L) | 1 part |
| Water | 83 parts |

COMPARATIVE EXAMPLE 2

To the same substrate as used in Example 1, the coating solution (1-a) was applied by bar coating in an amount giving a dried coating weight of 20 $g/m^2$ followed by drying at 110° C. for 5 minutes, and further followed by super-calendering to give a recording medium of a comparative example.

COMPARATIVE EXAMPLE 3

To the same substrate as used in Example 1, the following coating solution (13-a) was applied by bar coating in an amount giving a dried coating weight of 20 $g/m^2$ followed by drying at 110° C. for 5 minutes, and further followed by super-calendering to give a recording medium of a comparative example.

| (Coating solution 13-a) | |
|---|---|
| Basic magnesium carbonate (available from Konoshima Kagaku K.K.; trade name: KINSEI) | 12 parts |
| Polyvinyl alcohol (available from Kuraray Co., Ltd; trade name: PVA-117) | 2 parts |
| Polyvinyl alcohol (available from Kuraray Co., Ltd; trade name: PVA-105) | 2 parts |
| Polyallylamine hydrochloride (available from Nitto Boseki Co., Ltd.; trade name: PAA.HCl-10L) | 1 part |
| Water | 83 parts |

COMPARATIVE EXAMPLE 4

A recording medium of a comparative example was prepared in entirely the same manner as in Example 1 except that the coating solution for the lower layer was replaced with the following coating solution (15-a).

| (Coating solution 15-a) | |
|---|---|
| Synthetic silica (available from Fuji-Davison Chemical Ltd.; trade name: Syloid 620; specific surface area: 300 $m^2/g$; average particle diameter: 12 $\mu m$) | 15 parts |
| Polyvinyl alcohol (available from Kuraray Co., Ltd; trade name: PVA-117) | 2.5 parts |
| Polyvinyl alcohol (available from Kuraray Co., Ltd; trade name: PVA-105) | 2.5 parts |
| Water | 80 parts |

COMPARATIVE EXAMPLE 5

A recording medium of a comparative example was prepared in entirely the same manner as in Example 1 except that the coating solution for the lower layer was replaced with the following coating solution (16-a).

| (Coating solution 16-a) | |
|---|---|
| Synthetic silica (available from Fuji-Davison Chemical Ltd.; trade name: Syloid 620) | 10 parts |
| Basic magnesium carbonate (available from Konoshima Kagaku K.K.; trade name: KINSEI) | 5 parts |
| Polyvinyl alcohol (available from Kuraray Co., Ltd; trade name: PVA-117) | 2.5 parts |
| Polyvinyl alcohol (available from Kuraray Co., Ltd; trade name: PVA-105) | 2.5 parts |
| Water | 80 parts |

COMPARATIVE EXAMPLE 6

A recording medium of a comparative example was prepared in entirely the same manner as in Example 1 except that the coating solution for the lower layer was replaced with the following coating solution (17-a) and the coating solution for the upper layer was replaced with the following coating solution (17-b).

| (Coating solution 17-a) | |
|---|---|
| Synthetic silica (available from Mizusawa Industrial Chemicals, Ltd.; trade name: Mizukasil P-527; specific surface area: 55 $m^2/g$; average particle diameter: 1.8 μm) | 15 parts |
| Polyvinyl alcohol (available from Kuraray Co., Ltd; trade name: PVA-117; degree of saponification: 98.5%; degree of polymerization: 1,700) | 2.5 parts |
| Polyvinyl alcohol (available from Kuraray Co., Ltd; trade name: PVA-105; degree of saponification: 98.5%; degree of polymerization: 500) | 2.5 parts |
| Water | 80 parts |
| (Coating solution 17-b) | |
| Synthetic silica (available from Tokuyama Soda Co., Ltd.; trade name: Finesil K-41) | 8 parts |
| γ-Alumina (available from Sumitomo Chemical Co., Ltd.; trade name: AKP-G) | 4 parts |
| Polyvinyl alcohol (available from Kuraray Co., Ltd; trade name: PVA-117) | 2 parts |
| Polyvinyl alcohol (available from Kuraray Co., Ltd; trade name: PVA-105) | 2 parts |
| Polyallylamine hydrochloride (available from Nitto Boseki Co., Ltd.; trade name: PAA.HCl-10L) | 1 part |
| Water | 83 parts |

Ink-jet recording suitability of the above recording mediums was evaluated by carrying out ink-jet recording using an ink-jet printer having ink-jet heads corresponding to 4 colors of Y (yellow), M (magenta), C (cyan) and Bk (black), provided with 128 nozzles at intervals of 16 nozzles per 1 mm and capable of ejecting ink droplets by the action of heat energy, and using inks with the following composition.

| Ink composition | |
|---|---|
| Dye | 5 parts |
| Diethylene glycol | 20 parts |
| Water | 78 parts |
| Dye | |
| Y: | C.I. Direct Yellow 86 |
| M: | C.I. Acid Red 35 |
| C: | C.I. Direct Blue 199 |
| Bk: | C.I. Food Black 2 |

Evaluation was made on the following three items.

(1) Image density:

Solid printing was carried out using the above ink-jet printer, and the optical density (OD) of black (Bk) of the print was evaluated with a Macbeth reflection densitometer RD-918.

(2) Chroma of images:

Solid printing was carried out using the above ink-jet printer, and the chroma of red (yellow+ magenta) areas of the print was evaluated with a color analyzer CA-35 (manufactured by Murakami Shikisai Kenkyusho).

(3) Indoor color changes:

An ozone test method similar to the method disclosed in Japanese Patent Application Laid-open No. 64-75280 was employed, and the ΔE*ab observed on C.I. Food Black 2 was used as a basis for the evaluation of indoor color changes.

The test was carried out under conditions as follows:

(i) The interior of a test chamber is light-screened, fresh ozone is always fed from the interior or exterior of the chamber, and its concentration is set to be always maintained within the range of 3±0.3 ppm.

The air in the interior is also set to be always circulated by convection.

(ii) Environmental conditions are set to be within the range of 40° C.±2° C. and 60±3% RH. Test pieces having been stored for 2 days in the above environment after their manufacture are used so that the volatile components in the ink can be completely evaporated and also the quantities of water adsorbed in test pieces can be kept constant.

(iii) Test pieces are exposed to ozone for 2 hours in the test chamber in which the conditions of (i) and (ii) have been set.

How to determine measurements:

The color difference ΔE*ab of each test piece before and after the exposure to ozone for 2 hours in the above test chamber is determined according to JIS-Z-8730, and the resulting value is regarded as color change ΔE*ab of C.I. Food Black 2. Results of the evaluation are shown in Table 1 below.

TABLE 1

| | OD (Bk) | Chroma (Red) | Ozone color change ΔE* (Bk) |
|---|---|---|---|
| Example: | | | |
| 1 | 1.41 | 75 | 3.2 |
| 2 | 1.39 | 75 | 2.1 |
| 3 | 1.35 | 71 | 4.0 |
| 4 | 1.43 | 75 | 5.2 |
| 5 | 1.45 | 76 | 6.0 |
| 6 | 1.42 | 74 | 4.7 |
| 7 | 1.38 | 72 | 3.5 |
| 8 | 1.41 | 74 | 2.5 |
| 9 | 1.38 | 74 | 2.8 |
| 10 | 1.39 | 73 | 5.5 |
| Comparative Example: | | | |
| 1 | 1.26 | 64 | 3.3 |
| 2 | 1.35 | 74 | 12.4 |
| 3 | 1.28 | 64 | 1.4 |
| 4 | 1.40 | 75 | 13.6 |
| 5 | 1.39 | 75 | 11.4 |
| 6 | 1.42 | 76 | 21.4 |

As shown in the above, the recording mediums according to the present invention were confirmed to have achieved a high image density, a high chroma at the part into which multicolor inks were simultaneously shot, and also a satisfactory inhibition of indoor color changes.

In particular, a great effect was seen in the inhibition of color changes when the basic magnesium carbonate was used as a pigment in the lower layer. It was also possible to obtain a sufficient image density because of the greater proportion of the aluminum oxide used in the upper layer.

On the other hand, the recording mediums of comparative examples were unsatisfactory in any of image density, chroma of multicolor inks and inhibition of indoor color changes.

As having been described above, the present invention provides an ink-jet recording medium having settled the subject that the image density must be kept at a sufficiently high level and at the same time the indoor color changes must be inhibited, and also can retain a high chroma at the multicolor ink area.

We claim:

1. An ink-jet recording medium comprising a substrate and a pigment layer provided on the substrate, wherein said pigment layer comprises i) an upper layer containing as a major pigment an aluminum oxide and ii) a lower layer containing as a major pigment an aluminum oxide having a smaller specific surface area than the aluminum oxide in the upper layer.

2. An ink-jet recording medium according to claim 1, wherein the aluminum oxide contained in said upper layer as a major pigment has a specific surface area ranging from 90 $m^2/g$ to 170 $m^2/g$ and the aluminum oxide contained in said lower layer as a major pigment has a specific surface area of less than 90 $m^2/g$.

3. An ink-jet recording medium according to claim 2, wherein the aluminum oxide contained in said lower layer as a major pigment has a specific surface area of less than 60 $m^2/g$.

4. An ink-jet recording medium according to claim 1, wherein the aluminum oxide contained in said upper layer has an average particle diameter of not more than 70 $\mu m$.

5. An ink-jet recording medium according to claim 1, wherein the aluminum oxide contained in said upper layer as a major pigment is in an amount not less than 50% by weight of all pigments contained in said upper layer.

6. An ink-jet recording medium according to claim 1, wherein said upper layer is provided in a coating weight of from 1 $g/m^2$ to 10 $g/m^2$.

7. An ink-jet recording medium according to claim 1, wherein the aluminum oxide contained in said lower layer as a major pigment has an average particle diameter of not more than 20 $\mu m$.

8. An ink-jet recording medium according to claim 1, wherein the aluminum oxide contained in said lower layer as a major pigment is in an amount not less than 60% by weight of all pigments contained in said lower layer.

9. An ink-jet recording medium according to claim 1, wherein said lower layer is provided in a coating weight of from 1 $g/m^2$ to 29 $g/m^2$.

10. An ink-jet recording medium comprising a substrate and a pigment layer provided on the substrate, wherein said pigment layer comprises i) an upper layer containing as a major pigment an aluminum oxide having a specific surface area ranging from 90 $m^2/g$ to 170 $m^2/g$ and ii) a lower layer containing as a major pigment an inorganic pigment having a specific surface area of not more than 150 $m^2/g$, selected from the group consisting of a carbonate or silicate of calcium, a carbonate or silicate of magnesium, a silicate of aluminum and hydrotalcite, and wherein the specific surface area of the major pigment in the upper layer is larger than the specific surface area of the major pigment in the lower layer.

11. An ink-jet recording medium according to claim 10, wherein said inorganic pigment contained in said lower layer as a major pigment has a specific surface area of not more than 100 $m^2/g$.

12. An ink-jet recording medium according to claim 10, wherein the aluminum oxide contained in said upper layer has an average particle diameter of not more than 70 $\mu m$.

13. An ink-jet recording medium according to claim 10, wherein the aluminum oxide contained in said upper layer as a major pigment is in an amount not less than 50% by weight of all pigments contained in said upper layer.

14. An ink-jet recording medium according to claim 10, wherein said upper layer is provided in a coating weight of from 1 $g/m^2$ to 10 $g/m^2$.

15. An ink-jet recording medium according to claim 10, wherein said inorganic pigment contained in said lower layer as a major pigment has an average particle diameter of not more than 20 $\mu m$.

16. An ink-jet recording medium according to claim 10, wherein said inorganic pigment contained in said lower layer as a major pigment is in an amount not less than 60% by weight of all pigments contained in said lower layer.

17. An ink-jet recording medium according to claim 10, wherein said lower layer is provided in a coating weight of from 1 $g/m^2$ to 29 $g/m^2$.

18. An ink-jet recording medium comprising a substrate and a pigment layer provided on the substrate, wherein said pigment layer comprises i) an upper layer containing as a major pigment an aluminum oxide having a specific surface area ranging from 90 $m^2/g$ to 170 $m^2/g$ and ii) a lower layer containing as a major pigment a basic magnesium carbonate having a specific surface area of not more than 150 $m^2/g$, and wherein the specific surface area of the major pigment in the upper layer is larger than the specific surface area of the major pigment in the lower layer.

19. An ink-jet recording medium according to claim 18, wherein the basic magnesium carbonate contained in said lower layer as a major pigment has a specific surface area of not more than 100 $m^2/g$.

20. An ink-jet recording medium according to claim 18, wherein the aluminum oxide contained in said upper layer has an average particle diameter of not more than 70 $\mu m$.

21. An ink-jet recording medium according to claim 18, wherein the aluminum oxide contained in said upper layer as a major pigment is in an amount not less than 50% by weight of all pigments contained in said upper layer.

22. An ink-jet recording medium according to claim 18, wherein said upper layer is provided in a coating weight of from 1 $g/m^2$ to 10 $g/m^2$.

23. An ink-jet recording medium according to claim 18, wherein the aluminum oxide contained in said lower layer as a major pigment has an average particle diameter of not more than 20 $\mu m$.

24. An ink-jet recording medium according to claim 18, wherein the inorganic pigment contained in said lower layer as a major pigment is in an amount not less than 60% by weight of all pigments contained in said lower layer.

25. An ink-jet recording medium according to claim 18, wherein said lower layer is provided in a coating weight of from 1 $g/m^2$ to 29 $g/m^2$.

26. An ink-jet recording method comprising forming an image by imparting ink droplets to the ink-jet recording medium according to any one of claims 1 to 25.

27. An ink-jet recording method comprising forming an image by imparting to the ink-jet recording medium according to any one of claims 1 to 25, ink droplets ejected from a nozzle by the action of heat energy.

28. An ink-jet recording method comprising forming a multi-color image by imparting plural-color ink droplets to the ink-jet recording medium according to any one of claims 1 to 25.

29. An ink-jet recording method comprising forming a multi-color image by imparting to the ink-jet recording medium according to any one of claims 1 to 25, plural-color ink droplets ejected from nozzles by the action of heat energy.

* * * * *

UNITED STATES PATENT AND TRADEMARK OFFICE

CERTIFICATE OF CORRECTION

PATENT NO. : 5,171,626

DATED : December 15, 1992

INVENTOR(S) : Nagamine et al.

It is certified that error appears in the above-identified patent and that said Letters Patent is hereby corrected as shown below:

ON THE TITLE PAGE:

[56] References Cited:

FOREIGN PATENT DOCUMENTS

"6475280 3/1989 JAPAN" should read --64-75280 3/1989 JAPAN--.

[57 ABSTRACT:

Line 11, "are" should read --area--.

COLUMN 5:

Line 45, "word," should read --words,--.

Signed and Sealed this

Twenty-first Day of December, 1993

Attest:

Bruce Lehman

BRUCE LEHMAN

Attesting Officer

Commissioner of Patents and Trademarks